United States Patent [19]

Pali

[11] Patent Number: 4,586,415

[45] Date of Patent: May 6, 1986

[54] ASSEMBLY FOR EFFECTING VERTICAL AND ROTATIONAL MOTION

[75] Inventor: Christopher Pali, Fort Wayne, Ind.

[73] Assignee: Essex Group, Inc., Fort Wayne, Ind.

[21] Appl. No.: 617,308

[22] Filed: Jun. 4, 1984

[51] Int. Cl.[4] ..... B26D 5/04; B65H 19/20

[52] U.S. Cl. ..... 83/564; 83/453; 83/488; 269/24; 242/58.6

[58] Field of Search ..... 242/58.1-58.6; 269/24, 27; 83/453, 488, 564

[56] References Cited

U.S. PATENT DOCUMENTS

| | | | |
|---|---|---|---|
| 3,292,477 | 12/1966 | Raftery | 83/564 X |
| 3,362,301 | 1/1968 | Kohlitz | 269/24 X |
| 4,454,794 | 6/1984 | Thornton | 83/488 |

*Primary Examiner*—Donald R. Schran
*Attorney, Agent, or Firm*—Robert P. Hayter

[57] ABSTRACT

Apparatus for displacing a working member both vertically and rotationally is disclosed. A shaft is slidably mounted within a sleeve mounted for rotational displacement within a frame. A working member is secured to a hub which is secured to the shaft such that it may be both vertically displaced and rotationally displaced. A yoke assembly is connected between a vertical actuator and the shaft for effecting vertical displacement of the shaft without limiting rotational displacement. Additional means are provided for rotating the sleeve to effect rotational movement of the shaft. The sleeve is connected to the shaft such that rotational movement of one causes the other to rotate without limiting sliding displacement therebetween.

8 Claims, 4 Drawing Figures

ASSEMBLY FOR EFFECTING VERTICAL AND ROTATIONAL MOTION

BACKGROUND OF THE INVENTION

The invention relates to an assembly for effecting vertical and rotational displacement of a working member. More particularly the invention concerns the vertical displacement and rotation of a knife assembly or ribbon clamp assembly for securing a ribbon in position and cutting the ribbon. Additionally sensing means are included for positively sensing that the motion of the working member is as desired.

In order to provide a continuous ribbon of material to a process it is sometimes necessary to unwind large rolls of ribbon material. These rolls of ribbon material may be mounted on a chuck assembly and unwound at a desired rate. Upon the termination of one roll it is necessary to join the beginning end of the next roll to be mounted to the chuck assembly to the trail end of the expired roll.

As disclosed in related patent application entitled "Method and Apparatus For Unwinding And Splicing Successive Rolls", Ser. No. 617,992, a paster arm assembly may be utilized to swing up about a pivot point which is also the pivot point for a pulley over which the ribbon is guided. On the paster arm assembly are a ribbon clamp assembly for releasably clamping the ribbon to secure the tension between the clamping point and a dancer downstream therefrom, a vacuum cup for securing the cut end of the ribbon in position for later application of an adhesive and a ribbon knife assembly for selectively cutting the ribbon to provide a trail end from the old roll.

It is necessary that both the ribbon clamp assembly and the ribbon knife assembly have a working member which is positioned so as not to interfere with the orderly unwinding of the ribbon material during unwinding operations. Additionally this working member must be capable of being displaced upwardly to pass over the ribbon when the paster arm has been rotated upwardly in contact with the ribbon and then thereafter be displaced downwardly to either clamp the ribbon between a clamp bar and a clamp pad or to cut the ribbon between a stationary knife blade and a moving knife blade. After the operation has been complete the working member must again be displaced upwardly and rotated back to the starting rotational position. The working member may then be displaced downwardly to its beginning point. Hence it may seen that there must be provided an effective mechanism for controlling the rotational and vertical displacement of the working member.

In order to provide a failsafe system it is desirable to detect that the mechanism has made each motion as required. This provides a safety check to determine that the working member has been displaced either upwardly or downwardly and that the working member has been displaced either between an in or an out position. By positively sensing the position of the working member the successive steps may be sequenced thereafter.

SUMMARY OF THE INVENTION

It is an object of the present invention to provide an apparatus for effecting vertical and rotational displacement of a working member.

It is a further object of the present invention to provide means for clamping a ribbon to hold it in position.

It is a yet further object of the present invention to provide means for cutting a ribbon with a knife blade.

It is a still further object of the present invention to provide apparatus for sensing the position of a working member both in the rotational and vertical directions.

It is a still further object of the present invention to provide a failsafe, reliable, easy to service and maintain assembly for effecting the desired movement of a workpiece.

Other objects will be apparent from the description to follow and the appended claims.

The above objects are achieved according to the preferred embodiment of the invention by the provision of apparatus for displacing a working member both vertically and rotationally. The apparatus includes a sleeve mounted for rotational displacement within a frame, a shaft slidably mounted within the sleeve, means rotationally securing the sleeve to the shaft such that rotation of either the sleeve or shaft effects rotation of the other, a hub fixed to the shaft and defining means for securing the working member to the hub such that the working member is displaced vertically by sliding movement of the shaft and displaced rotationally by rotation of the sleeve and shaft, a vertical actuator for effecting vertical motion, yoke means connecting the vertical actuator to the hub for translating vertical motion from the vertical actuator to the hub without limiting rotational displacement of the hub, collar means connected to the sleeve, and a rotational actuator connected to the collar means for displacing the collar means to cause rotational motion of the the sleeve.

Additionally disclosed are a series of position indicators and position sensors for positively detecting the presence of an indicator at a specific position to indicate that the workpiece has been displaced to the desired location.

DESCRIPTION OF THE PREFERRED EMBODIMENT

Apparatus as described herein will refer to a specific mechanism for effecting rotational and vertical displacement of a working member. As described the apparatus will be directed to a ribbon clamp assembly and a ribbon knife assembly for use in clamping and cutting a ribbon material passing therethrough. It is to be understood that this invention has like applicability to other types of operations requiring similar movement.

As described herein actuators will be utilized to effect rotational and vertical displacement. These are shown as an up-down cylinder and a rotation cyclinder anticipating that these might be air or hydraulic powered cylinders. Of course, any similar motion creation device would achieve the same function.

Figure 1:
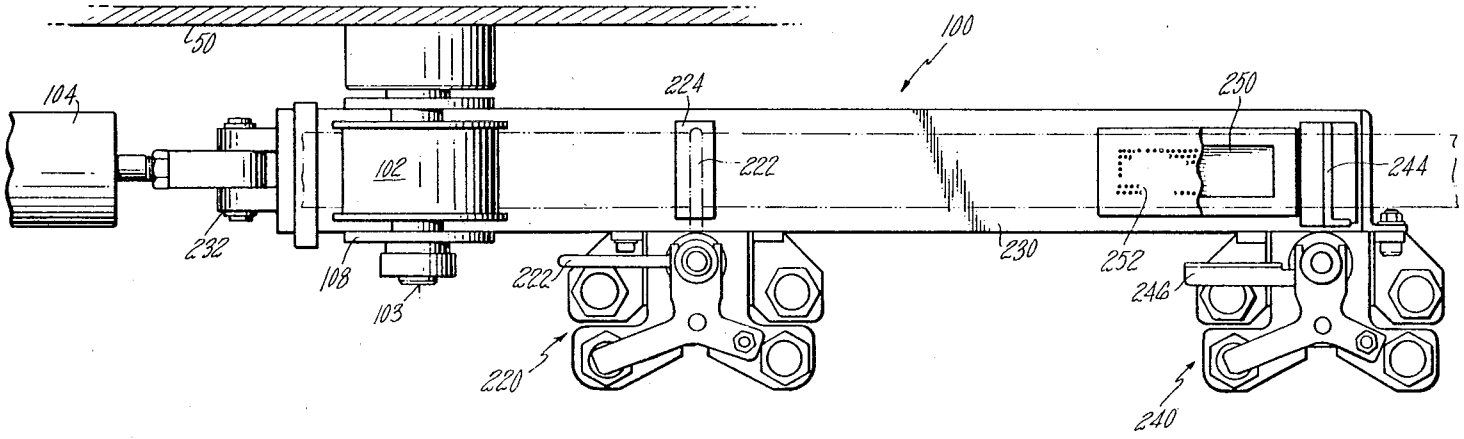
FIG. 1 is a top view of a paster arm assembly including a ribbon clamp assembly and a ribbon knife assembly.

Referring now to FIG. 1 we see an enlarged view of a portion of paster arm assembly 100. Actuator 104 is shown as a pressurized cylinder for causing paster arm assembly 100 to rotate about pivot point 103. Actuator 104 is connected to the main body of the paster arm assembly via pivot connection 232. Arm support 108 extends from pulley 102 to paster arm 230 to support same relative to pivot point 103. The paper payoff assembly frame 50 is shown indicating that portion of the machine to which the paster arm is secured.

Ribbon clamp assembly 220 is shown mounted on the side of paster arm 230. The ribbon clamp assembly includes a clamp bar 222 which may be rotated from a closed position as shown to an open position wherein ribbon 60 is secured between clamp pad 224 and clamp bar 222. Paster arm 230 additionally has vacuum cup 250 secured on the top thereof such that the paper ribbon travels across the top of the vacuum cup. A neoprene cover 252 is shown partially in section having a plurality of openings such that a suction is drawn through each to secure the paper in position.

Ribbon knife assembly 240 is shown mounted at the end of paster arm 230 and includes stationary knife blade 244 and a rotating knife blade 246. When actuated the knife assembly acts to displace the rotating knife upwardly and to rotate it out over the paper ribbon. It is then displaced downwardly to cut the ribbon prior to being rotated back to the original position. The ribbon clamp assembly works in a similar manner with the clamp bar being displaced upwardly and then rotated outwardly over the ribbon. The clamp bar is then displaced downwardly to secure the ribbon in position. Upon being released the clamp bar is displaced upwardly and then rotated back to its original position.

Figure 2:
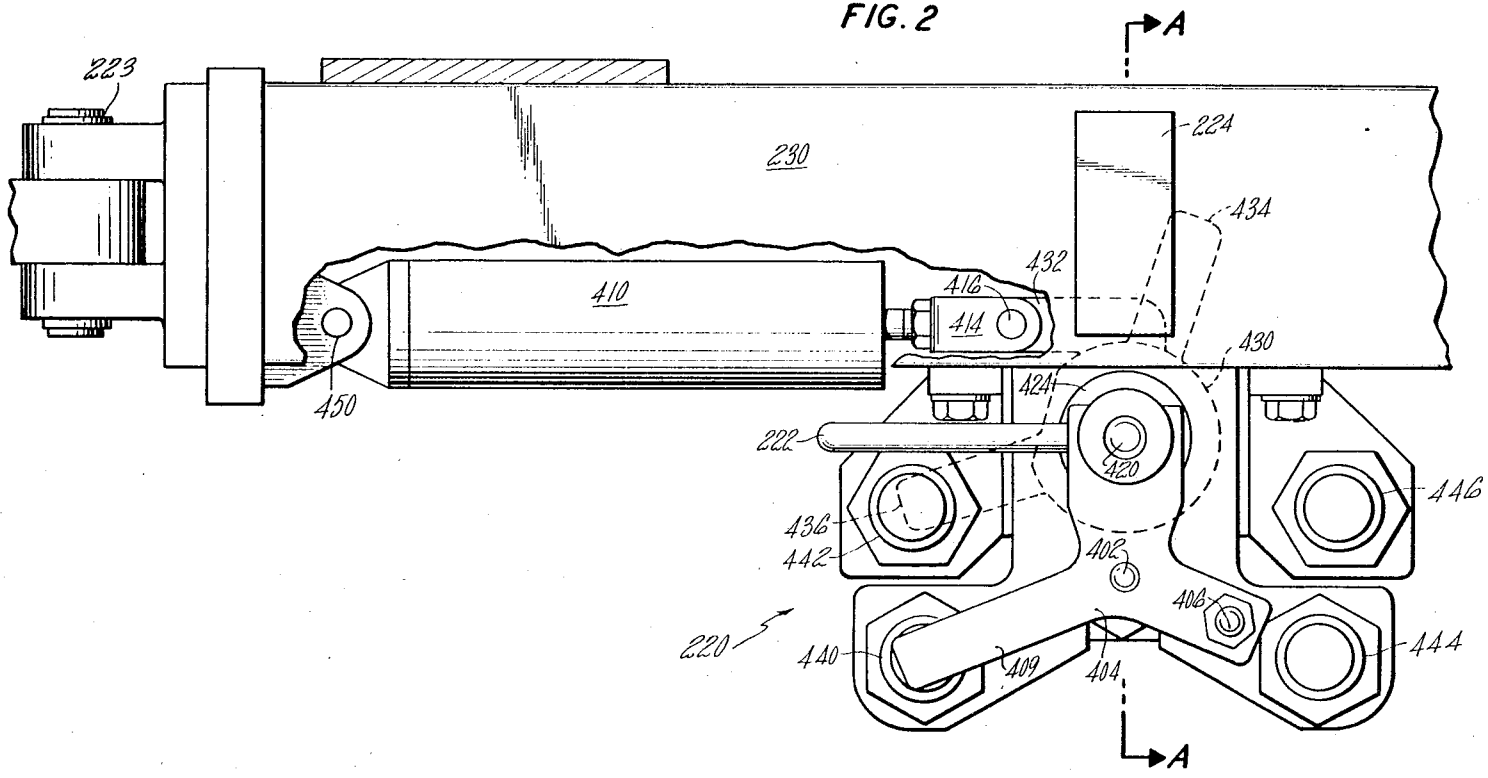
FIG. 2 is an enlarged top view of the ribbon clamp assembly.
Figure 3:
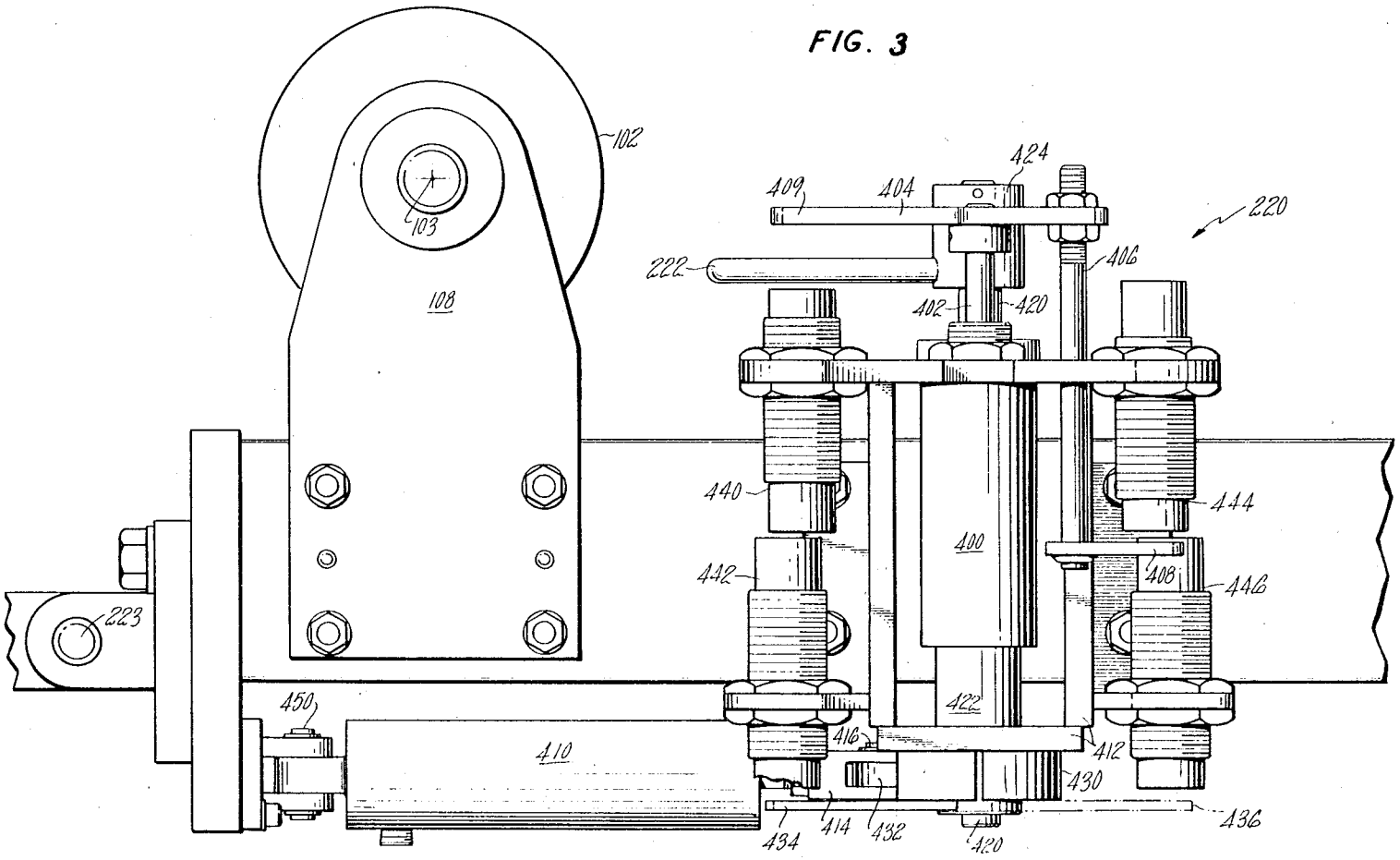
FIG. 3 is a side view of the ribbon clamp assembly.
Figure 4:
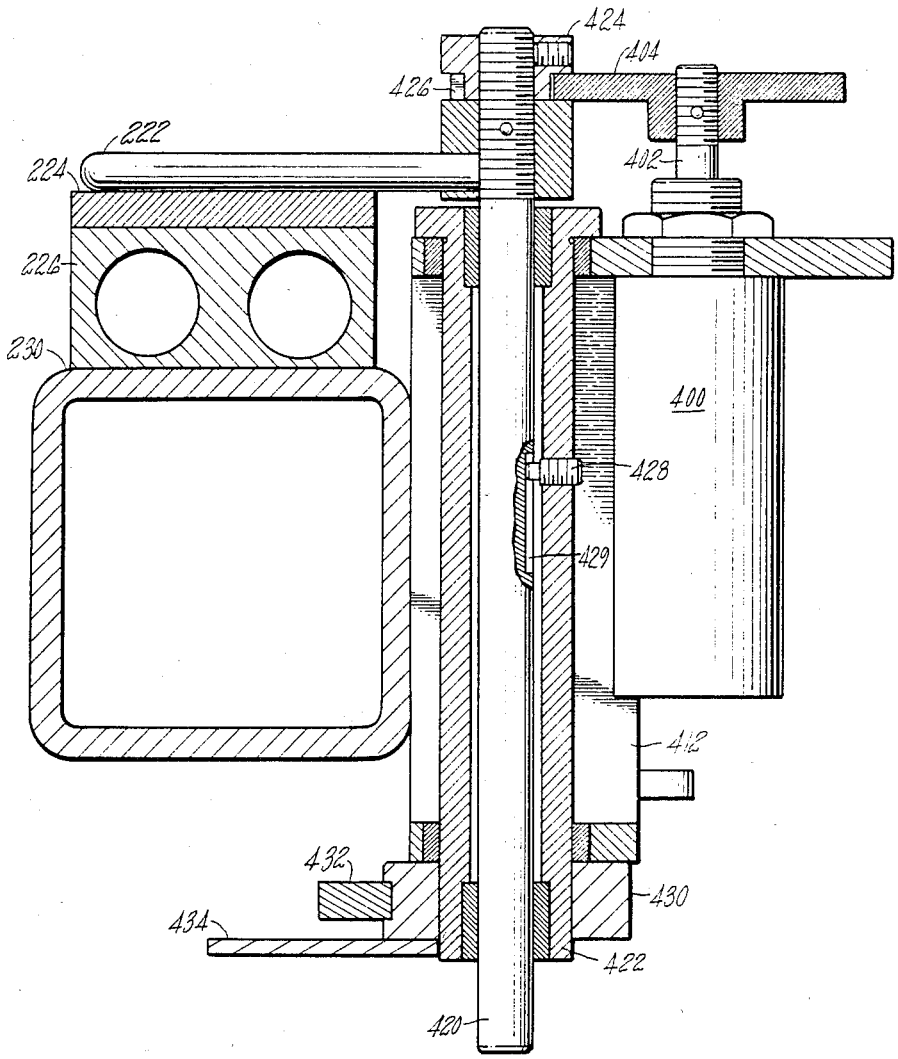
FIG. 4 is a sectional view of the ribbon clamp assembly taken at line A—A having the position sensors omitted.

Referring now to FIGS. 2, 3 and 4 the specific details of the ribbon clamp assembly will be disclosed. The details of construction and operation of the ribbon clamp assembly are identical to those of the knife assembly.

FIG. 2 is a top view of ribbon clamp assembly 220 similar to the view as seen in FIG. 1. In FIG. 2 it may be seen that a rotation cylinder 410 is mounted at the bottom of paster arm 230 and is connected thereto via pivot connection 450. This rotation cylinder is the device that imparts rotational displacement to the clamp bar. Also as seen from the top view of FIG. 2 is clamp pad 224 and clamp bar 222. It is between clamp bar 222 and clamp pad 224 that the ribbon is secured.

Spaced about the assembly are position sensors 440, 442, 444 and 446. Each sensor cooperates with a position indicator to sense the presence of metal at a desired location. The sensor is utilized to determine that the clamp bar has been moved as desired. It will be explained more particularly in reference to another view the manner in which the sensors cooperate with the indicators to determine that the clamp bar is in the desired position.

Clamp bar 222 is mounted to hub 424 which is mounted about shaft 420. Yoke 404 is engaged within a slot defined by hub 424 such that an upward or downward displacement of yoke 404 causes the hub and the attached clamp bar to be displaced upwardly or downwardly.

Rotation cylinder 410 has a cylinder yoke 414 extending therefrom. Collar 430 having a collar extension 432 extending therefrom is mounted to the bottom of shaft 420. The collar extension has an opening therein through which pin 416 extends connecting collar extension 432 to cylinder yoke 414. Hence, by energization of the rotation cyclinder the collar extension 432 is caused to be displaced acting to rotate the collar which rotates the sleeve which rotates the shaft and consequently rotates hub 424 and clamp bar 222. The in position indicator 423 and the out position indicator 436 are shown in the drawing. Additionally shown is connecting rod 406 extending from yoke 404. The down position indicator 409 is also shown extending from yoke 404.

Referring now to FIGS. 3 and 4 a different view of the assembly may be seen. FIG. 3 is a side view of the paster arm assembly showing pivot connection 223 and arm support 108 engaged to pivot point 103 which also supports pulley 102. Rotation cylinder 410 is shown mounted at the bottom of the arm and is secured thereby by pivot connection 450.

Clamp bar 222 is shown in the up position and is partially hidden by down position indicator 409. As shown in the up position, up-down cylinder 400 has been energized to cause rod 402 to be displaced upwardly moving yoke 404 upward. Yoke 404 is connected to hub 424 and acts to cause the hub with the attached clamp bar to be displaced upwardly. Shaft 420 also attached to the hub is displaced upwardly simultaneously. Extending from yoke 404 is down position indicator 409.

Additionally in FIG. 3 there may be seen down position sensor 440, out position sensor 442, up position sensor 444 and in position sensor 446. Connecting rod 406 is shown extending downwardly from yoke 404 and has up position indicator 408 extending therefrom.

As shown the yoke has been displaced upwardly by up-down cylinder 400. Hence, down position indicator 409 is displaced from down position sensor 440 such that the down position sensor which is a simple RF sensor indicating the presence of metal in proximity thereto does not sense the down position. At the same time via connecting rod 406, up position indicator 408 has been moved into proximity with up position sensor 444 which then senses that the clamp bar is in the up position. When the up-down cylinder is in the down position the entire assembly is moved downwardly such that up position indicator 408 is moved away from up position sensor 444 such that it does not detect the presence of metal and simultaneously down position indicator 409 is moved into close proximity to down position sensor 440 such that it does detect the presence of metal in close proximity. Hence, the up or down position may be affirmatively detected in either instance.

Similarly, in position indicator 436 and out position indicator 434 are mounted to collar 430 which is secured to rotate with shaft 420. When the clamp bar is in the in position, in position indicator 436 is in close proximity to in position sensor 446 and out position indicator 434 is rotated away from out position sensor 442. The opposite position is indicated when the clamp bar has been rotated to the out position. In this case the in position indicator 436 is rotated away from in position sensor 446 and out position indicator 434 is rotated into close proximity to out position sensor 442 such that the out position is detected. Hence, in this manner the relative out or in rotational position of the clamp bar is affirmatively sensed.

Rotating cylinder 410 is shown connected through cylinder yoke 414 by pin 416 to collar extension 432 connected to collar 430. By displacement of the cylinder yoke the collar is caused to rotate through collar extension 432 thereby causing the clamp bar to rotate.

FIG. 4 is a sectional view of clamp bar assembly 220 taken at line A—A of FIG. 2. Paster arm 230 is shown being a square structural member having a clamp pad support 226 mounted to the top thereof. Clamp pad 224 is mounted at the top of clamp pad support and is a soft surface such as rubber which coacts with clamp bar 222 to secure the ribbon therebetween.

Mounted at the right portion of the drawing is shown up-down cylinder 400 having rod 402 extending therefrom into engagement with yoke 404. Yoke 404 is shown extending into slot 426 within hub 424. Hence it may be seen as up-down cylinder 400 is either extended or retracted the hub is caused to be displaced either upwardly or downwardly effecting displacement of clamp bar 222 either upwardly or downwardly.

Hub 424 is shown mounted to shaft 420 for both rotation and upward-downward displacement therewith. Shaft 420 is secured within sleeve 422 for relative axial sliding displacement thereto. Drive pin 428 is shown extending through sleeve 422 and being engaged within slot 429 defined by the shaft such that the sleeve is caused to rotate with the shaft and vice versa. Collar 430 is shown secured to the exterior surface of sleeve 422 and has collar extension 432 extending therefrom. It is to this collar extension that cylinder yoke 414 is connected for effecting rotation of the collar extension to rotate the collar, to rotate the sleeve, which rotates the shaft, which rotates the clamp bar. Hence, in this manner the clamp bar may be rotated between the in and out positions. Simultaneously the shaft may be slid upwardly and downwardly by the action of up-down cylinder 400. Out position indicator 434 is shown at the bottom of the drawing connected to collar 430 for relative rotational displacement therewith.

Hence, as may be seen in the ribbon clamp assembly and in the same manner for the knife clamp assembly, each provides for the clamp bar or a knife blade to be displaced upwardly rotated out over the ribbon and then displaced downwardly to either clamp the ribbon in position or to sever the ribbon in coaction with a stationary knife blade. To reverse the cycle the clamp bar or knife blade is displaced upwardly and rotated back into the starting rotational position and then displaced downwardly into the start position. Hence, the two assemblies act to effect both rotational and vertical displacement of the desired apparatus.

The invention has been described with reference to a particular embodiment. It is to be understood by those skilled in the art that variations and modifications can be effected within the spirit and scope of the invention.

I claim:

1. Apparatus for displacing a working member both vertically and rotationally which comprises:

a sleeve mounted for rotational displacement within a frame;

a shaft slidably mounted within the sleeve;

means rotationally securing the sleeve to the shaft such that rotation of either the sleeve or shaft effects rotation of the other;

a hub fixed to the shaft and defining means for securing the working member to the hub such that the working member is displaced vertically by sliding movement of the shaft and displaced rotationally by rotation of the sleeve and shaft;

a vertical actuator for effecting vertical motion;

yoke means connecting the vertical actuator to the hub for translating vertical motion from the vertical actuator to the hub without limiting rotational displacement of the hub;

collar means connected to the sleeve; and a rotational actuator connected to the collar means for displacing the collar means to cause rotational motion of the sleeve.

2. The apparatus as set forth in claim 1 wherein the hub defines a slot and wherein the yoke means includes a U-shaped projection extending within the slot without preventing rotation of the hub.

3. The apparatus as set forth in claim 1 wherein the means for rotationally securing the sleeve to the shaft further comprises:

the shaft defining an axially extending shaft slot; and a drive pin secured in the sleeve and extending into the shaft slot such that rotation of either the sleeve or shaft causes the other to rotate and the shaft may be slidably displaced within the sleeve with the drive pin being displaced within the shaft slot.

4. The apparatus as set forth in claim 1 wherein the working member has an in position and an out position and further comprising:

an in position indicator connected to rotate with the sleeve;

an out position indicator connected to rotate with the sleeve;

an in positon sensor connected to the frame and positioned to sense the presence of the in position indicator when the working member is in the in position; and an out position sensor connected to the frame and positioned to sense the presence of the out position indicator when the working member is in the out position.

5. The apparatus as set forth in claim 4 wherein the working member has an up position and a down position and further comprising:

an up position indicator connected to the yoke means to be vertically displaced therewith;

a down position indicator connected to the yoke means to be vertically displaced therewith;

an up position sensor mounted to the frame and positioned to sense the presence of the up indicator when the working member is in the up position; and a down position sensor mounted to the frame and positioned to sense the presence of the down indicator when the working member is in the down position.

6. The apparatus as set forth in claim 1 and further comprising:

a cooperating member connected to the frame and coacting with the working member to achieve a desired result.

7. The apparatus as set forth in claim 6 wherein the working member is a knife blade and wherein the cooperating member is a stationary knife blade.

8. The apparatus as set forth in claim 6 wherein the working member is a clamp bar and wherein the cooperating member is a clamp pad.

* * * * *